United States Patent [19]

Trendov

[11] 4,003,232

[45] Jan. 18, 1977

[54] METHOD AND APPARATUS FOR CONTINUALLY FORMING SPHERICAL OBJECTS

[76] Inventor: Asparough (Oscar) Trendov, 4257 Wooddale Ave. South, Minneapolis, Minn. 55416

[22] Filed: Aug. 7, 1975

[21] Appl. No.: 602,580

[52] U.S. Cl. ..... 72/68; 29/1.22; 29/148.4 B; 72/69; 164/272; 264/15

[51] Int. Cl.[2] ..... B21H 1/14

[58] Field of Search ..... 29/148.4 B, 527.1, 527.5, 29/527.7, 1.22; 164/272; 65/21, 142, 143; 72/88, 89, 90, 67, 68, 69; 264/15

[56] References Cited

UNITED STATES PATENTS

| | | | |
|---|---|---|---|
| 2,332,361 | 10/1943 | Anastor et al. | 65/142 |
| 2,867,000 | 1/1959 | Huszar | 29/148.4 B |
| 2,963,824 | 12/1960 | Pinotti | 65/21 |
| 3,223,508 | 12/1965 | Wolf | 65/21 |
| 3,597,177 | 8/1971 | Davidoff | 65/21 |

*Primary Examiner*—Lowell A. Larson
*Attorney, Agent, or Firm*—James R. Cwayna

[57] ABSTRACT

The method and apparatus for continually forming spherical objects such as steel balls or the like which balls are utilized in various grinding processes which apparatus and method includes at least one longitudinally extending forming tube with means for rotating the same wherein a predetermined amount of material is introduced at one end thereof and the rotation of the tube along with the downward movement of the material will form the introduced material into a substantially spherical shape and thereafter providing forming dies for compressing the formed object into a more positive spherical shape of a hardened compressed quality. The apparatus may include a plurality of such forming tubes with each such tube feeding the formed object into a set of forming dies wherein one set of the dies is rotated with the forming tubes past a stationary set of dies which forming dies are provided with forming grooves therein to compress and drive the balls to an exit portion of the apparatus.

17 Claims, 10 Drawing Figures

METHOD AND APPARATUS FOR CONTINUALLY FORMING SPHERICAL OBJECTS

FIELD OF THE INVENTION

This invention relates generally to means for providing a method for continually forming spherical balls wherein the balls are initially formed and are thereafter subjected to a compressing, forming operation.

BACKGROUND AND OBJECTS OF THE INVENTION

Various industries require the use of grinding mills for the pulverization and formation of material to provide a final product. These grinding mills very often include what are known as ball mills and the grinding device within the mills consists of a plurality of steel or metal balls which upon tumbling will pulverize the raw material into its intended form. Natually, during the operation of such a ball mill, the balls will ultimately be worn down and must be replaced.

Various means are presently utilied for the production of grinding balls and one such means includes the cutting of rod material and thereafter forging the same into a substantially spherical shape. The processes obviously include a multistep process in that the rod must first be produced, cut off and thereafter forged.

With applicant's concept a predetermined amount of material at a formable temperature is introduced into one end of a forming tube and the tube is rotated and as the tube is rotated, the introduced mass will take on a spherical form and will cool into a substantial spherical form due to the length of the tube and the amount of time that it takes to travel through the tube. At the end of this tube, the now substantially spherical member is introduced into a die section which is not the typically known hammer-type forge device but is rather a pair of dies which are particularly designed and particularly arranged for sliding movement with respect to one another such that the introduced material will follow a forming path as the dies pass one another which forming path is designed not only to further form and compress the ball into its desired spherical shape but is also designed to drive the ball in a particular direction which obviously is the exit portion of the die.

It is therefore an object of applicant's invention to provide the apparatus and the method for continually forming spherical objects.

It is a further object of applicant's invention to provide a method and apparatus for forming spherical objects such as grinding balls or the like by introducing the material to be formed at a temperature which permits forming thereof and to continually rotate and move this formable mass in a direction which will result in a substantially spherical object being formed.

It is a futher object of applicant's invention to provide the method and apparatus for forming spherical objects such as grinding balls and the like which includes the introduction of material at a formable temperature and directing this material in such a manner to provide a substantial spherical object at the exit end of a forming tube and thereafter introducing the same into a forming operation which will substantially compress the ball and insure the spherical shape and size thereof.

It is still a further object of applicant's invention to provide the method and apparatus for continually forming a plurality of spherical objects such as grinding balls or the like which includes a plurality of forming tubes with means for introducing a predetermined mass of material at a formable temperature therein and by continually rotating these forming tubes, the mass will be moved in a direction which will result in a substantially spherical object being formed therefrom, and thereafter, the balls or spherical objects will be introduced into a plurality of forming dies which dies will compress the material into a desired state of hardness and more positively into the desired shape and size.

These and other objects and advantages of the invention will more fully appear from the following description made in connection with the accompanying drawings in which the same numeral is used to designate the same or similar parts throughout the several views, and in which.

Figure 1:
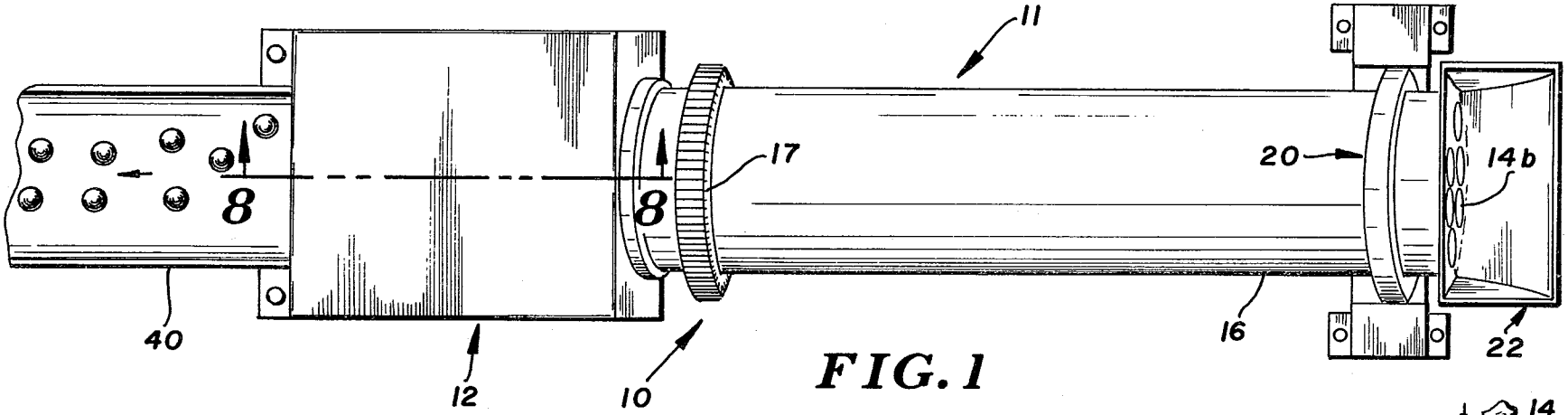
FIG. 1 is a top plan view of a continual spherical ball forming mechanism embodying the concepts of applicant's invention.
Figure 5:
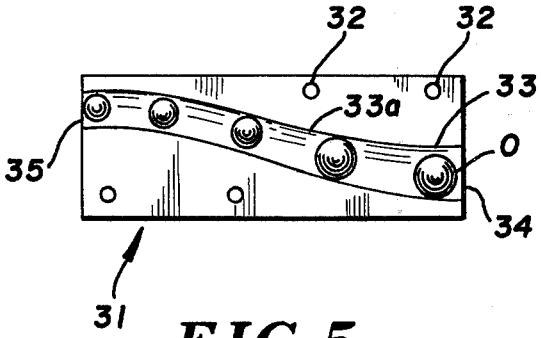
FIG. 5 is a section taken substantially along Line 5—5 of FIG. 4.
Figure 6:
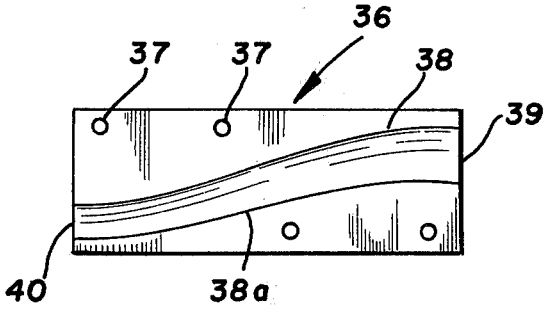
FIG. 6 is a section taken substantially along Line 6—6 of FIG. 4.
Figure 7A:
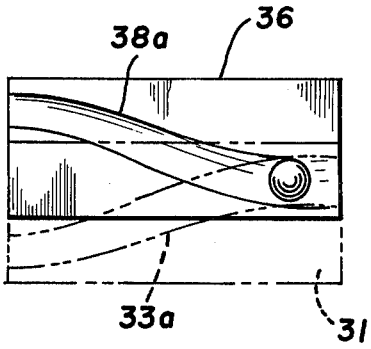
Figure 7B:
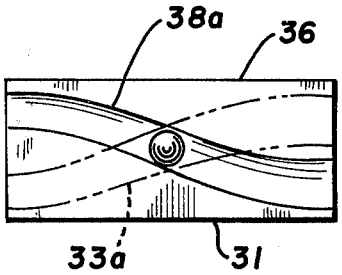
Figure 7C:
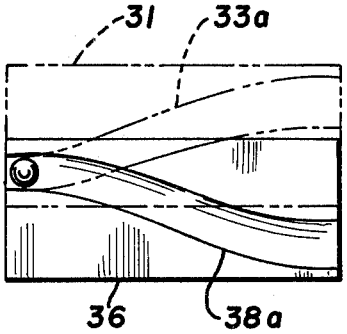
Figure 8:
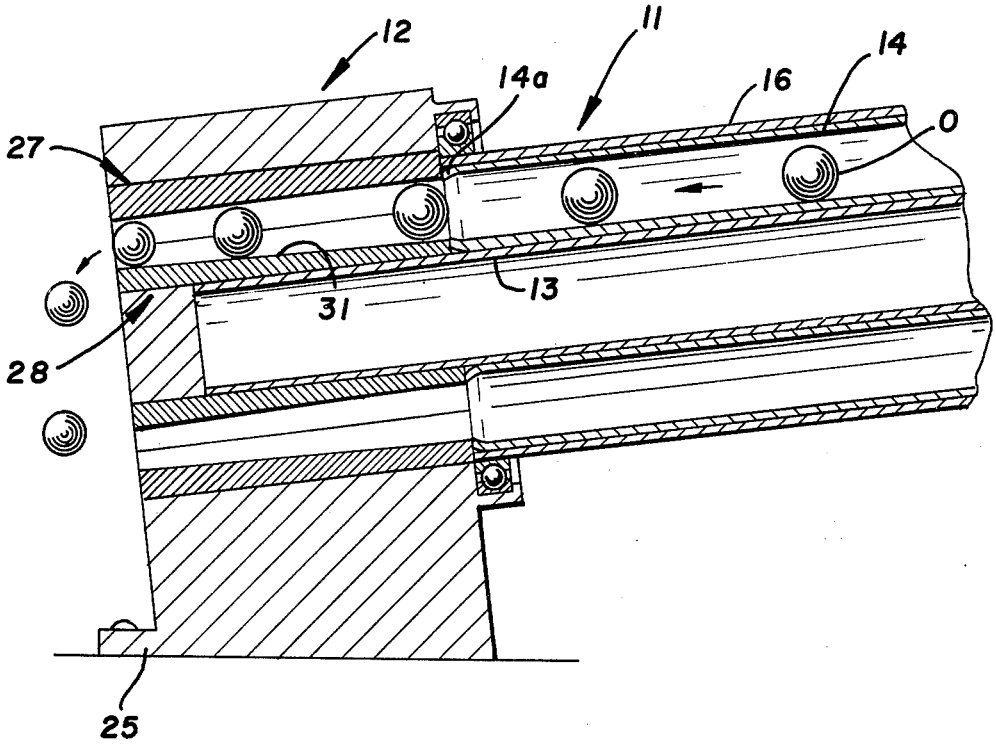

FIG. 7*a* is a view which illustrates the overlapping of FIGS. 5 and 6, the die of FIG. 6 being illustrated in dotted lines and the die of FIG. 5 being illustrated in solid lines and illustrating the overlapping arrangement of the die paths formed therethrough with a ball being illustrated therein;

FIG. 7*b* is a view taken sequentially from FIG. 7*a* illustrating continued relative movement of the die portions as illustrated in FIGS. 5 and 6 again illustrating a ball being formed therein; p FIG. 7*c* is a further sequential view of FIG. 7*b* illustrating the continual relative movement of the dies of FIGS. 5 and 6 and again illustrating the ball moving theirin and being in exiting position realtive thereto; and, FIG. 8 is a vertical section taken substantially along Line 8—8 of FIG. 1.

In accordance with the accompanying drawings, applicant's apparatus for continually forming spherical objects is generally designated 10 and includes a first forming section 11 and a second compression section which is contained within a base housing which is generally designated 12. The housing 12 as will be further described hereinafter includes means for mounting the forming seciton 11 at an angular relation with respect to horizontal which may vary from between 3° to 7°.

The forming section 11 in the form shown, includes a first longitudinally extending support member 13, in this form being cylindrical in configuration and extending longitudinally entirely along the unit 11 and extending inwardly of housing 12. This cylindrical configuration of support 13 is chosen strictly as a matter of selection and this section could be provided in many various forms as the unit 13 simply provides a means for mounting a plurality of forming tubes 14 thereon in arcuately spaced relationship therearound. Obviously, the number of such forming tubes 14 could be varied around the support member 13 or if high production is not a major consideration, a single forming tube 14 could be supplied without departing from the scope of the invention. It should also be noted that, although a select number of such forming tubes 14 are illustrated, that the entire arcuate or circumferential dimension of the support tube 13 could be completely covered with such forming tubes.

As illustrated in FIG. 8, the forming tubes may be provided with a necked-down area 14*a* adjacent the housing 12 for the delivery of the formed spherical objects O properly into the forging section contained within the housing 12.

Forming tubes 14 are of a predetermined length and of a predetermined internal diameter to correspond with the size of the spherical object that will be formed through utilization of the device. The ball to be formed must be able to be rotated and follow the inner circumference of the forming tube 14 and therefore the inner diameter of such forming tube must permit the inserted mass to rotate therein. Applicant has found that the size of the forming tube 14 with respect to the spherical object being formed should be anywhere from 2 to 4 times the diameter of the desired resultant ball.

The lengths of these forming tubes 14 is designed such tat the material placed therein at the receiving ends 14*b* thereof will be received in a formable range of temperature. Obviously, if the material to be formed is a steel or iron product, this temperature range may vary from 2200° to 2500°. the length of the tubes is calculated such that after reaching the delivery end 14*a* of the tubes 14 the temperature of the objects O therein will still be maintained at a forging or formable temperature.

Figure 2:
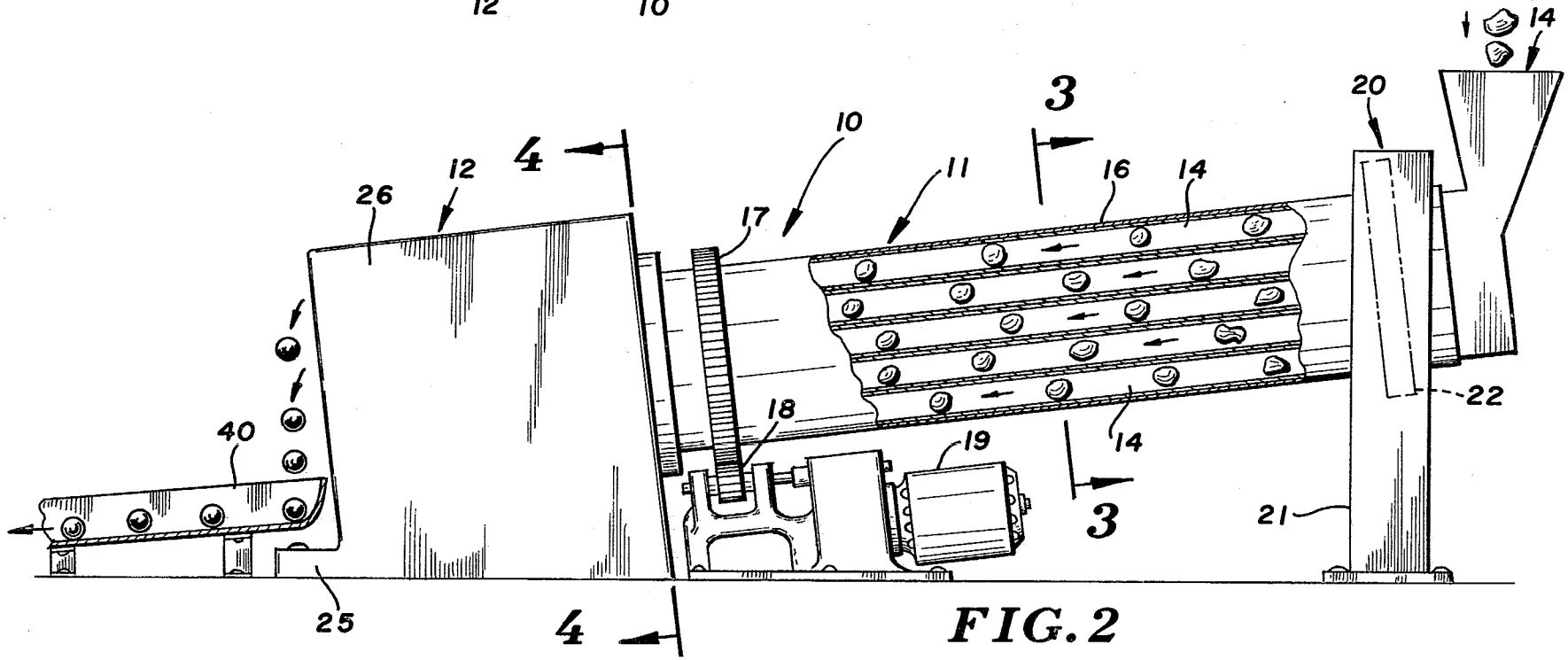
FIG. 2 is a side view thereof with certain portions thereof being broken away for clarity.
Figure 3:
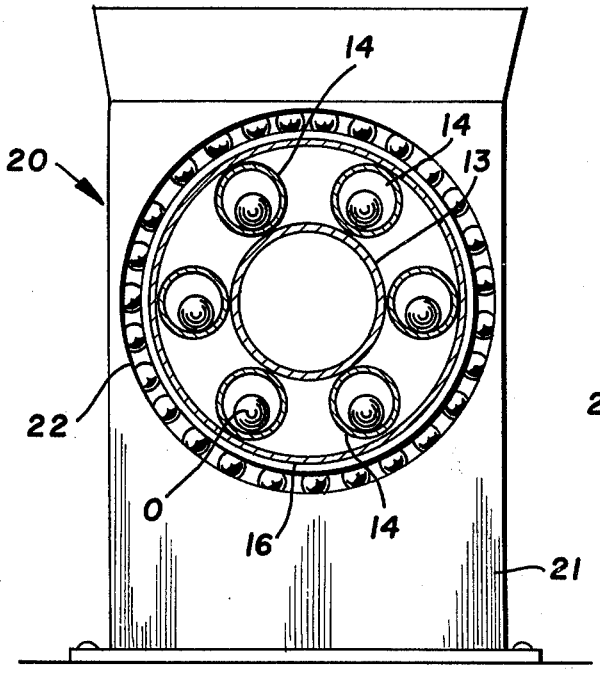
FIG. 3 is a section taken substantially along Line 3—3 of FIG. 2.
Figure 4:
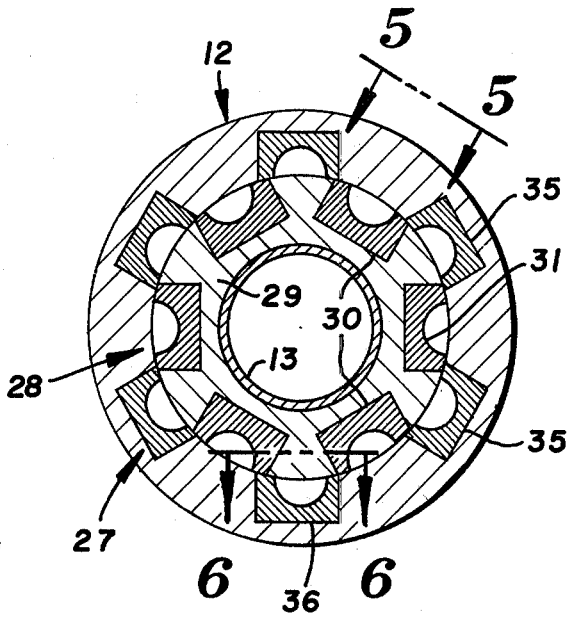
FIG. 4 is a section taken substantially along Line 4—4 of FIG. 2.

As illustrated in the drawings and particularly FIGS. 2, 3 and 8, an all-concompassing outer support tube 16 is provided about the exterior of these forming tubes 14 and this exterior tube 16 provides an additional support for the tubes 14 and provides a means for providing an exterior bearing surface and exterior driving surface for a ring gear 17, pinion 18 and motor combination 19 on one end thereof adjacent the housing such that rotary force may be applied to the entire unit. An annular bearing support 20 is arranged at the other end thereof which annular support is best illustrated in FIG. 3 which illustrates a substantially vertical support member 21 having a ring bearing 22 mounted therein which ring bearing 22 obviously must be angularly arranged such that it will be in axial alignment with the outer support 16 and permit rotation of the same therein.

This type of bearing structure could consist of roller bearings or the like and is simply an outer end support for the entire forming tube structure.

With the structure then disclosed, it should be obvious that rotary motion is applied to the entire structure comprising the individual feed forming tubes 14 and these will be rotated along with the support member 13 through the ring gear-pinion combination.

A feed device generally designated 22 is provided on the receiving end 14*b* of the forming tubes 14 and this hopper or delivery type feeding device is illustrated as a hopper unit which is provided to deliver predetermined amounts of material to the individual tubes. This unit must in effect be a metering device which will provide a predetermined amount of material at the predetermined elevated temperature into the individual tubes. This hopper or feed unit could be one of many forms or could in actuality be a hand measuring operation and therefore applicant deems it only necessary to illustrate this device as a feeding unit which could simultaneously and selectively place a predetermined amount of material into each of the individual forming tubes 14. Obviously, a high production device would call for measured feeding at measured intervals of the material into the forming tubes 14.

The die housing 12 includes a base portion 25 and an exterior housing 26 for an outer stationary die section designated generally 27 and an inwardly disposed rotatable die section designated 28 to which the inner support tube 13 is securely attached such that the inner rotatable die 28 and the support tube 13 will be rotated simultaneously. Bearing structures must be provided for proper registration of the inner die 28 with respect to the outer die and this may be accomplished through various structural arrangements.

Inner die section 28 basically combines a generally cylindrical housing portion 29 having a plurality of inwardly directed die housing sections 30 formed therein, which die sections are each provided with a die member 31. These die members 31 extend longitudinally of the housing 12 and the particular configuration of each such die member is particularly illustrated in FIGS. 5, 6 and 7*a*, *b* and *c*. In FIG. 5, an individual die section 31 is illustrated as a longitudianlly extending plate which of course must be of a strength and quality to perform a compressing function and therefore would obviously be of a relatively hard material. The configuration as illustrated in FIG. 5 permits the die sections 31 to be inset or replaced into the carrying cylinder 29 through a plurality of attachment members provided through apertures 32 in the die plate 31. As illustrated in FIG. 5, the die or forming path is designated 33 and consists of a path formed longitudinally through the die wherein an input end 34 of the path is a first predetermined size and the output end 35 thereof is of a slightly reduced diameter. The concept of providing this type of configuration is to form and provide a compressing action on the spherical object O as the same is received from the output end 14*a* of the forming tube 14.

In conjunction with each of the inner dies 31, an outer die 36 is provided and this die 36 again is provided in radially outwardly extending grooves 36 formed in the housing of the unit 12. The individual die sections 36 are illustrated in FIG. 6 and again, attachment members 37 or attachment apertures 37 are provided therethrough such that these individual die sections 36 may be replaced within the housing 12. In the form shown, a forming path again is formed in die 36 and this path is designated 38.

A consideration of the forming paths 33 and 38 in the stationary and rotating die 31, 36 will now be given. As illustrated in these figures, the input ends 34, 39 of the respective dies 31, 36 are of a predetermined size which will accept the spherical object O as the same is delivered from the delivery end of the forming tube 14. The output ends 35 of stationary die 31 and output ends 40 of rotating die 36 are reduced from the input ends thereof such that as the formed spherical object is passed within the die paths 33, 38, a compressing function will be developed against the object. As shown in FIGS. 5 and 6, each of the paths includes the entrance end 34, 39 being substantially straight adjacent the entry portion thereof and thereafter being angularly formed in opposite directions to the output ends 35, 40 thereof. The co-action of these particular dies is particularly illustrated in FIGS. 7*a*, 7*b* and 7*c*. As illusrated in these figures, as the rotating die 31 moves, its input end 34 will come into alignment with the input end 39 of the stationary die 36. It is at this point that an obect O may pass into the die forming sections from the forming tubes 14. The object will drop into the straight section and thereafter will enter the oppositely curved portions 33*a*, 38*a* of the defined paths 33, 38. The angular configuration of these die paths is such that as the dies 31, 36 are moved past each other a longitudinal driving force is applied to the ball which will force the ball or spherical object from the input end to the output end and will at the same time compress the ball. The simplest explanation for this effect is to envision a scissors with an uncutable object placed between the blades thereof. As the blades are moved together, the object will be forced longitudianlly of the blades and finally will exit when the blades are fully closed. In this situtiion, each of the die portions 31, 36 are provided with semicircular grooves 33, 38 extending the longitudinal length thereof and by providing these grooves of a reduced diameter from the input to the output ends thereof, compression of the ball will take place. As illustrated in FIGS. 7*a*, 7*b* and 7*c*, the ball is always captured at the juncture of the die grooves; the change in dimension of which will provide the compression and positive formation for the ball. After the ball has been forced through the die sections 31, 36, it exits the housing 12 and the balls may be delivered through a gravity feed trough 40 or the like.

It should be obvious that the forming tubes 14 as particularly illustrated in FIG. 8 terminate adjacent the housing 12 and the die sections 27, 28. It should also be obvious that the inner die member 28 is maintained in alignment with the delivery end 14 of the forming tube. As the entire tube 14 structure and the inner die 28 are rotated, they will come into registration with the outer die members 27 such that a ball may be delivered into the forming or compression section. It should also be obvious that when utilizing, as in the form shown, a structure consisting of six such forming tubes, it will be possible to deliver six balls from each tube into the die sections with each rotation of the forming unit.

As a modification of this structure, it should be obvious that the unit could be greatly increased in size or the number of forming tubes and die sections could be substantially increased to increase the productivity of the unit and the main configuration and consideration is that the timing of feeding the material into the receiving end of the tubes must be arranged to prevent an accumulation of balls within the tubes 14 and further that the off-set arrangement of the oppositely directed die paths must provide a longitudinally directed force to the ball. At certain angles, there would be a locking function performed and the ball would not move downwardly through the forging unit but rather would lock the unit into a non-moving situation. This entire compression or dieing device and angular configuration of the slots of course depends upon the length and diameter of the die section.

Applicant's unit also lends itself to a singular configuration wherein one feed tube would be utilized and this tube would simply be rotated and the metal to be formed would be delivered at one end thereof in its predetermined weight and the rotation of the tube would cause the metal to be formed into a generally spherical shape. If a single tube were utilized, then the die structure could take a simple reciprocating shape in which the die sections were flat and were placed in face to face relationship to each other and only one die were movable with respect to a stationary die. In this situation, the same path configuration would be utilized as illustrated in these circular dies and for that purpose, these dies may be considered to be no more than flat plates which are bent to a predetermined radius. Reciprocation of these flat dies would of course result in the same scissors type function which would compress and force the spherical object longitudinally through themselves. This, of course, would be a low production situation and applicant has illustrated herein a device which is capable of a relatively higher production situation.

The method for forming these spherical grinding balls or spherical balls of any other material then is to provide a longitudinally extending, generally cylidnrical forming member with means to rotate the same and referably means for rotating the same about a predetermined center point with means for introducing a mass of the material to be formed into an upper elevated end thereof which mass is predetermined from the size and weight and therefore density and quality of the final product and allowing this mass to enter the tube and be rotated therewith along the tube for a predetermined period which will result in the material being formed into a generally spherical shape and thereafter forging or compressing the same while the same is in a malleable condition through a pair of dies that have an oppositely direct and converging path defined therein and moving the dies in such a manner to move the spherical object through the dies while continually compressing the same to its desired final configuration.

The structure for accomplishing this method with applicant's device is to provide an elongated hollow tubular structure elevated at one end thereof to provide a gravity flow therethrough with means for rotating the same and preferably rotating the same about a fixed center with means for introducing a predetermined amount of material to be formed into the elevated receiving end thereof and thereafter introducing the formed article into a pair of forming dies which dies are provided with oppositely directed paths having an entrance end of a first predetermined dimension and an exit end of a second predetermined dimension and wherein the paths thereof will be in overlapping position at at least one point thereof during the entire relative movement of the dies which point is the position of the spherical object as the same is moved through the dies.

It should be obvious that applicant has provided, first a unique method and apparatus for initially forming a mass of material into a generally spherical shape through the utilization of a rotating forming tubular member and secondly, that applicant has provided a unique die and compression system for receiving the object provided by such initial forming device and compressing and reducing the same in dimension through movement of the dies to provide a spherical member of predetermined dimension and quality.

I claim:

1. A structure for forming substantially spherical objects including:

a. means defining a longitudinally extending axis of rotation;

b. at least one longitudinally extending, generally cylindrical material forming, tubular member having a material receiving end and a material delivery end mounted parallely to said axis of rotation and spaced parallely thereform;

c. means for rotating said forming member about said axis of rotation;

d. means for introducing a predetermined amount of formable material into said receiving end of said forming member; and, e. forming means arranged adjacent said delivery end of said forming member to receive an object therefrom.

2. The structure set forth in claim 1 and:

a. a longitudinally extending support member provided on the axis of rotation; and b. said material forming tubular member arranged adjacent said support member to be displaced parallely from said axis of rotation.

3. The structure set forth in claim 2 and a plurality of material forming members arranged circumferentially about said support member.

4. The structure set forth in claim 1 and said axis defining means arranged and constructed to position said forming member at an angle with respect to horizontal.

5. The structure set forth in claim 4 and wherein the mounting angle of sid forming member is between 3° and 7° with respect to horizontal.

6. The structure set forth in claim 1 and said forming means including:

a. a first die means;

b. a second die means;

c. one of said die means being movable, the other of said die means being stationary; and, d. means for shifting said movable die means past said stationary die means.

7. The structure set forth in claim 6 and:

a. a die housing member;

b. said forming means being mounted in said housing; and, c. said forming means being generally cylindrical in shape, and one of said die means being rotatable with respect to said other die means.

8. The structure set forth in claim 7 and said rotatable die means being joned to said tubular, forming member for rotation therewith.

9. The structure set forth in claim 8 and each of said die means including a generally semicircular, longitudinally extending path formed therein, said path arranged and constructed to receive an object from the delivery end of said tubular, forming member therein and force the same therethrough.

10. The structure set forth in claim 9 and the paths in said die means being equally angularly, longitudinally extending and being oppositely disposed to one another whereby relative movement of the dies will force the object along the paths.

11. The structure set forth in claim 9 and said paths through said dies defining, when in mating relation, an entrance end of a first dimention and an exit end of a second, smaller dimension.

12. The structure set forth in claim 11 and a plurality of said tubular, forming means, and a plurality of said die means adjacent the delivery ends thereof.

13. The structure set forth in claim 12 and one of said movable die means arranged with and adjacent to said delivery end of each of said tubular, forming means.

14. The method of forming substantially spherical objects including the steps of:

a. providing a generally tubular forming member at an angle with respect to horizontal;

b. rotating said forming member about an axis of rotation displaced from the normal axis of rotation of such member; and c. injecting a predetermined amount of material at a formable temperature into the elevated end of said forming member.

15. The method as set forth in claim 14 and said tubular member having a diameter in a range of 2 to 4 times the diameter of the spherical object to be formed.

16. The method as set forth in claim 14 and the material injected including a ferrous material, the temperature of said material being from 2200° F. to 2500° F.

17. The method as set forth in claim 14 and provision of forging means to continue formation and compression of the spherical object, said forging means arranged to receive the object from said tubular member.

* * * * *